US009993694B1

(12) United States Patent
Warren

(10) Patent No.: US 9,993,694 B1
(45) Date of Patent: Jun. 12, 2018

(54) RECREATIONAL DEVICE WITH ROTOR ASSEMBLY

(71) Applicant: William J. Warren, Frisco, TX (US)

(72) Inventor: William J. Warren, Frisco, TX (US)

( * ) Notice: Subject to any disclaimer, the term of this patent is extended or adjusted under 35 U.S.C. 154(b) by 0 days. days.

(21) Appl. No.: 15/640,230

(22) Filed: Jun. 30, 2017

Related U.S. Application Data

(63) Continuation-in-part of application No. 15/487,394, filed on Apr. 13, 2017.

(60) Provisional application No. 62/474,180, filed on Mar. 21, 2017, provisional application No. 62/458,677, filed on Feb. 14, 2017, provisional application No. 62/453,102, filed on Feb. 1, 2017, provisional application No. 62/433,362, filed on Dec. 13, 2016, provisional application No. 62/433,136, filed on Dec. 12, 2016.

(51) Int. Cl.
*A63B 43/00* (2006.01)

(52) U.S. Cl.
CPC ..... *A63B 43/002* (2013.01); *A63B 2043/001* (2013.01); *A63B 2243/007* (2013.01)

(58) Field of Classification Search
CPC ..... A63B 43/002
See application file for complete search history.

(56) References Cited

U.S. PATENT DOCUMENTS

| | | | |
|---|---|---|---|
| 3,256,020 | A | 6/1966 | Smith |
| 3,884,466 | A | 5/1975 | MacDonald et al. |
| 4,923,196 | A | 5/1990 | Rohring |
| 5,269,514 | A | 12/1993 | Adler et al. |
| 5,284,341 | A | 2/1994 | Routzong et al. |
| 5,458,329 | A | 10/1995 | Bushman et al. |
| 5,779,576 | A | 7/1998 | Smith, III et al. |
| 5,807,198 | A | 9/1998 | Grimm |
| 6,010,419 | A | 1/2000 | Rappaport et al. |
| 6,042,494 | A | 3/2000 | Rappaport et al. |
| 6,695,728 | B1 | 2/2004 | Eddins |
| 7,288,037 | B2 | 10/2007 | Myers |
| 8,777,785 | B2 | 7/2014 | Martino |
| 8,920,267 | B2 | 12/2014 | Gable |
| 9,782,636 | B2 | 10/2017 | Martino |
| 2001/0039221 | A1 | 11/2001 | Schneider |
| 2003/0027672 | A1 | 2/2003 | Leal et al. |
| 2003/0100391 | A1 | 5/2003 | Kessler |
| 2008/0039246 | A1 | 2/2008 | Martino |
| 2008/0039250 | A1 | 2/2008 | Martino |
| 2011/0009218 | A1 | 1/2011 | Wallach et al. |
| 2014/0235380 | A1 | 8/2014 | Martino |
| 2016/0067556 | A1 | 3/2016 | Martino |

*Primary Examiner* — Steven Wong
(74) *Attorney, Agent, or Firm* — Carr & Ferrell LLP

(57) ABSTRACT

Recreational footballs with rotor assemblies are provided herein. An example recreational device includes a shell forming a prolate spheroid frame, a shaft disposed within the prolate spheroid frame and located along a central axis defined by the prolate spheroid frame, and one or more fan assemblies each having a plurality of blades, the one or more fan assemblies rotating around or in conjunction with the shaft, the one or more fan assemblies changing at least one aerodynamic aspect of flight of the recreational device when air passes through the prolate spheroid frame and across the plurality of blades of the one or more fan assemblies as the recreational device spirals during flight.

8 Claims, 13 Drawing Sheets

RECREATIONAL DEVICE WITH ROTOR ASSEMBLY

CROSS-REFERENCE TO RELATED APPLICATIONS

The present application is a Continuation-in-Part of U.S. application Ser. No. 15/487,394, filed on Apr. 13, 2017, which claims the benefit of U.S. Provisional Application No. 62/433,136, filed on Dec. 12, 2016, and of U.S. Provisional Application No. 62/433,362, filed on Dec. 13, 2016; the present application also claims the benefit of U.S. Provisional Application No. 62/453,102, filed on Feb. 1, 2017, of U.S. Provisional Application No. 62/458,677, filed on Feb. 14, 2017, and of U.S. Provisional Application No. 62/474,180, filed on Mar. 21, 2017; all of the aforementioned applications are hereby incorporated by reference for all purposes, including all references and appendices cited therein.

FIELD OF TECHNOLOGY

Embodiments of the present disclosure are directed to recreational devices, and more particularly, to recreational devices that resemble a football having an approximate prolate spheroid shape. The football can include one or more rotor assemblies that alter aerodynamic attributes of the football during flight.

SUMMARY

According to some embodiments, the present disclosure is directed to a recreational device, comprising: (a) a shell forming a prolate spheroid frame; (b) a shaft disposed within the prolate spheroid frame and located along a central axis defined by the prolate spheroid frame; and (c) one or more fan assemblies each having a plurality of blades, the one or more fan assemblies rotating around or in conjunction with the shaft, the one or more fan assemblies changing at least one aerodynamic aspect of flight of the recreational device when air passes through the prolate spheroid frame and across the plurality of blades of the one or more fan assemblies as the recreational device spirals during flight.

According to some embodiments, the present disclosure is directed to a football, comprising: (a) two or more mid-section rotor assembly sections, each comprising: (i) a frame section that forms a part of an outer surface of the football; and (ii) a plurality of blades that are rotatably supported within the frame section, the plurality of blades rotating to create a lift force when the football is thrown; and (b) end caps coupled with the two or more mid-section rotor assembly sections to form a remainder of the football, each of the end caps having an opening to allow air to enter the football.

According to some embodiments, the present disclosure is directed to a recreational device (e.g., football), comprising: (a) two or more mid-section rotor assembly sections, each comprising: (i) a frame section that forms a part of an outer surface of the football; and (ii) a plurality of blades that are rotatably supported within the frame section, the plurality of blades rotating to create a lift force when the football is thrown; and (b) end caps coupled with the two or more mid-section rotor assembly sections to form a remainder of the football, each of the end caps having sealed ends as well as vents, the vents allowing air to enter the football when thrown.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DESCRIPTION OF EXEMPLARY EMBODIMENTS

Embodiments of the present disclosure are directed to recreational devices, and more particularly but not by way of limitation, to recreational devices that resemble a football having an approximate prolate spheroid shape.

While a prolate spheroid shape is contemplated, the recreational devices of the present disclosure can comprise any number of shapes as desired, such as cylindrical, ellipsoidal, and triangular (e.g., diamond shaped)—just to name a few.

Footballs of the present disclosure include one or more internal rotor assemblies that alter aerodynamic attributes of the football during flight. For example, the rotor assemblies can act as a turbine that increases and/or decreases a distance traveled by the football when thrown compared to a similar football without the one or more rotor assemblies disposed therein.

In some embodiments, the blades of the rotor assemblies are fixed. Air passes over the blades as the football spirals during flight. The passage of air over the blades will enhance a distance the football travels and spirals.

In various embodiments, the blades of the rotor assemblies rotate freely rather than being fixed. The rotor assemblies in these embodiments comprise a drum that mounts to one or more frame members that define the shape of the football. A plurality of radially arranged blades are disposed within the drum, similar to the configuration of a turbine. The radially arranged blades freely rotate clockwise or counterclockwise within the drum based on their respective left-handedness or right-handedness.

The frames of the footballs of the present disclosure comprise open inlet and outlet ends that allow air to pass through the frame and rotate the blades of the one or more internal rotor assemblies. In some embodiments, the open inlet end and open outlet end of the football are defined by an inlet rotor assembly and an outlet rotor assembly. One or more additional rotor assemblies can be disposed between the inlet rotor assembly and the outlet rotor assembly along a length of the frame.

These and other advantages of recreational devices of the present disclosure are described in greater detail herein with respect to the collective drawings.

Figure 1:
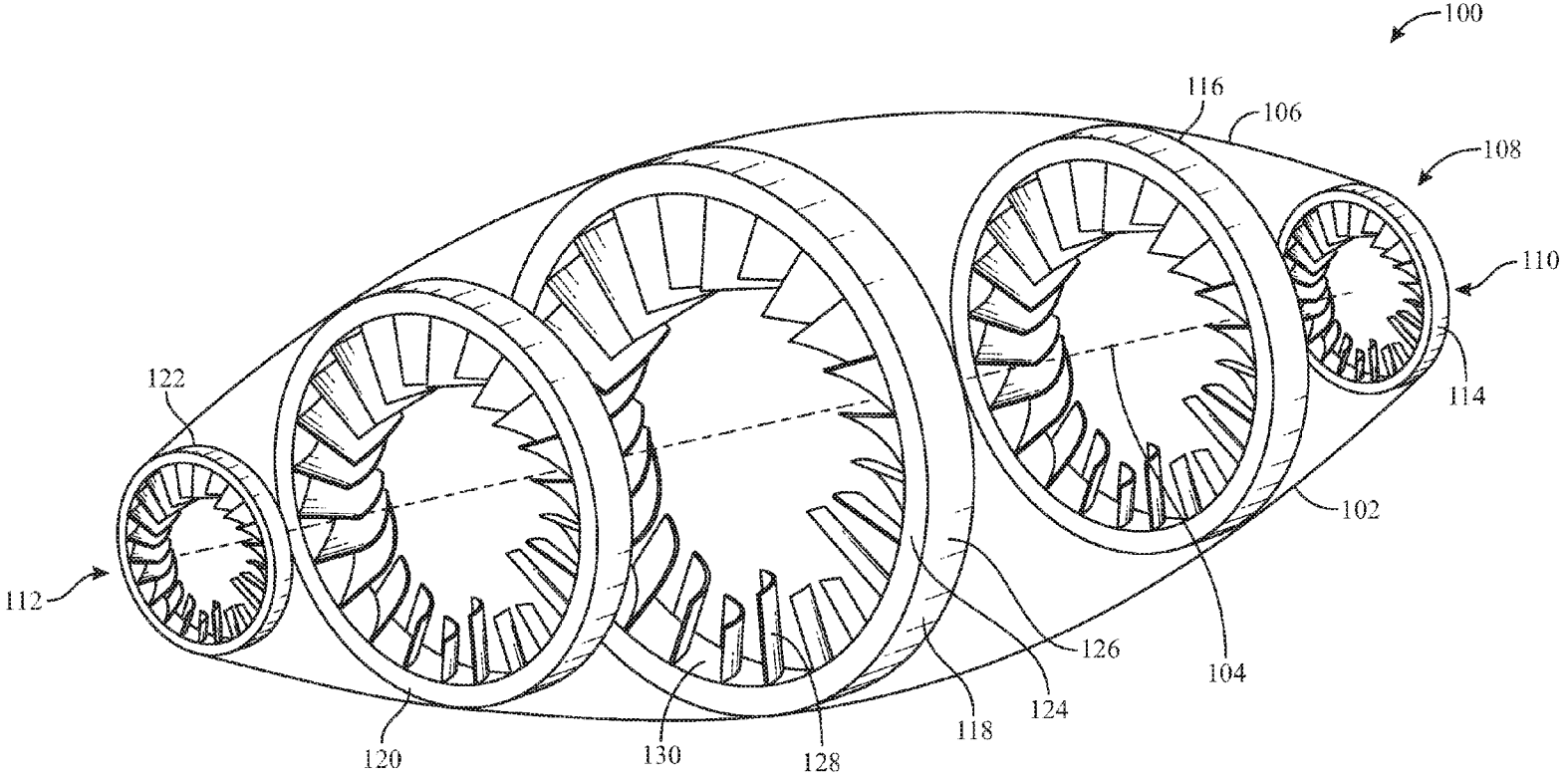
FIG. 1 is a perspective view of an example recreational device (e.g., a football), constructed in accordance with the present disclosure.

FIG. 1 illustrates an example recreational device (referred to hereinafter as "football 100"). The football 100 comprises a plurality of struts such as struts 102, 104, and 106 that collectively form a prolate spheroid frame 108. The struts 102, 104, and 106 can be manufactured from any suitable material such as a plastic, polymer, aluminum, carbon fiber, or any other suitable material or combination of materials. The struts 102, 104, and 106 form two ends of the football 100 that include an inlet end 110 and an outlet end 112.

In some embodiments, the football 100 comprises a plurality of rotor assemblies such as rotor assemblies 114, 116, 118, 120, and 122. The first, or inlet rotor assembly 114, defines an opening of the inlet end 110; while the last, or outlet rotor assembly 122, defines an opening of the outlet end 112.

Each of the rotor assemblies 114, 116, 118, 120, and 122 comprises a drum such as drum 124 of rotor assembly 118. While the rotor assemblies 114, 116, 118, 120, and 122 are generally similar in design to one another, the rotor assemblies 114, 116, 118, 120, and 122 can comprise varying shapes. The varying shapes of the rotor assemblies 114, 116, 118, 120, and 122 correspond to the shape of the prolate spheroid frame 108.

The drum 124 comprises a cylindrical drum frame or sidewall 126 that mounts to one or more of the struts 102, 104, and 106. A plurality of blades, such as blade 128, are disposed in a radial pattern within the drum 124. As mentioned above, in some embodiments, the plurality of blades are fixed within the drum 124.

In other embodiments, the plurality of blades can freely rotate within the drum 124. That is, the drum 124 provides rotatable support for the plurality of blades, allowing the plurality of blades to freely rotate similar to a turbine. In one embodiment, the plurality of blades can be associated with a drum surface, such as surface 130. The drum surface 130 can associate with (or be integral with) a race bearing 132 (see FIG. 2) or other similar cylindrical bearing that provides free rotation of the blades within the drum 124. According to various embodiments, the blades can rotate within the drum 124 as the football 100 spins or spirals while in flight. The spinning or spiraling of the football 100 can produce additional forward propulsion in the direction of travel of the football 100 as the blades in the football 100 rotate.

The blades can have unique geometrical configurations that include variances in cambering, twisting, angle of attack, and cross-sectional size along chord length—just to name a few. The blades each comprise a similar cambering and/or twisting that produce a right-handed effect or a left-handed effect. The radial arrangement of the blades within the drum 124 cause the blades of the rotor assemblies (such as rotor assembly 118) to rotate either clockwise or counterclockwise during flight, based on their right-handedness or left-handedness. This difference in right-handedness or left-handedness can either increase the distance the football 100 travels when thrown or can decrease the distance the football 100 travels when thrown. It may be advantageous to have the rotor assemblies increase the distance the football 100 travels, for example, when a child is throwing the football 100 and may not have sufficient upper body strength. Conversely, it may be advantageous to have the rotor assemblies decrease the distance the football 100 travels. For example, it may be desired to have the football 100 travel a shorter distance based on rotor assembly movement when a player desires to increase strength. The player will have to throw the football 100 harder to achieve the same travel distance when the player throws a similar football without the rotor assemblies. The rotor assemblies effectively increase resistance on the football 100 when thrown through the air.

Generally described, the rotor assemblies change at least one aerodynamic aspect of flight of the recreational device (e.g., the football) when air passes through the prolate spheroid frame and rotates (or is rotated by) the plurality of blades of the one or more rotor assemblies.

Figure 3:
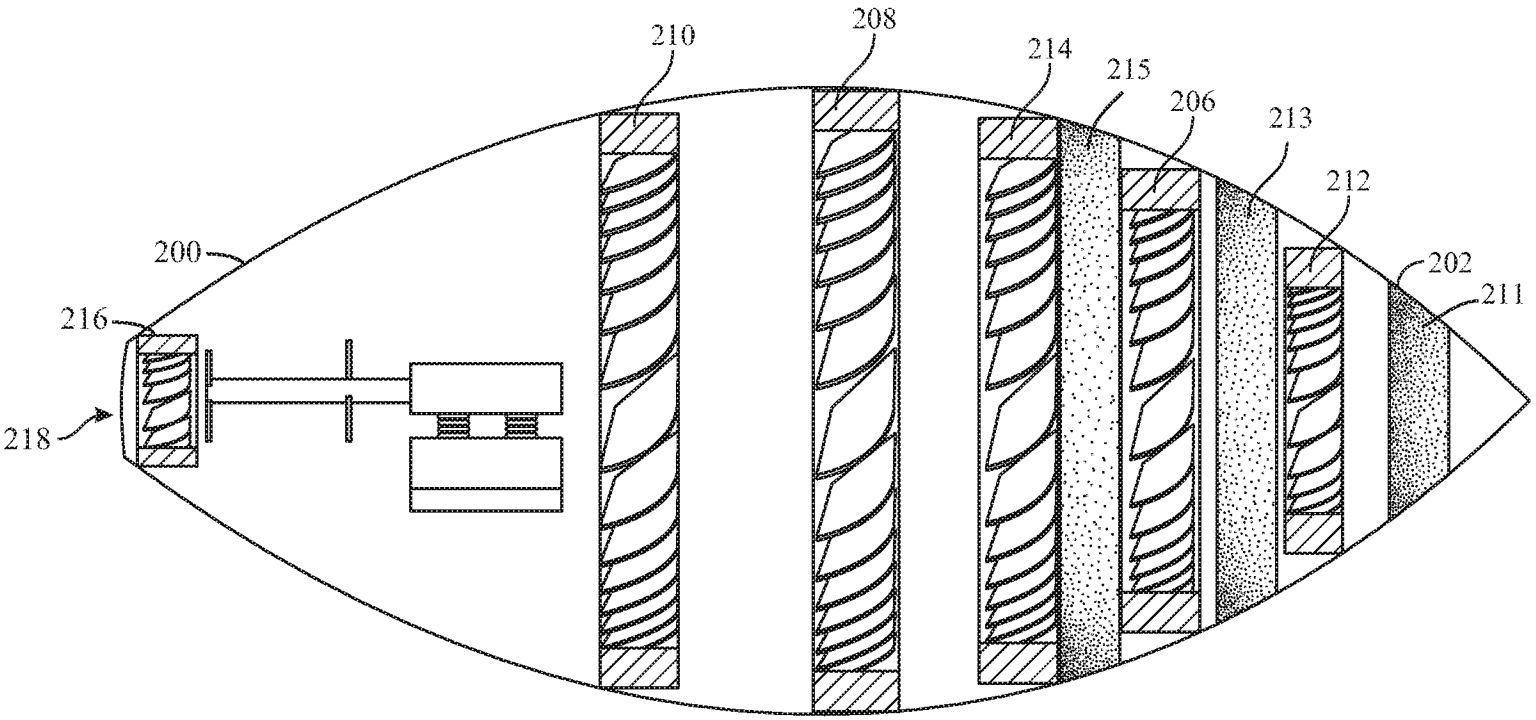
FIG. 3 is a side elevation, cross-sectional view of an example recreational device comprising a motor assembly.

The football 100 of FIG. 1 can be covered at least partially or entirely with a covering or skin, similarly to the embodiment of FIG. 3.

Figure 2:
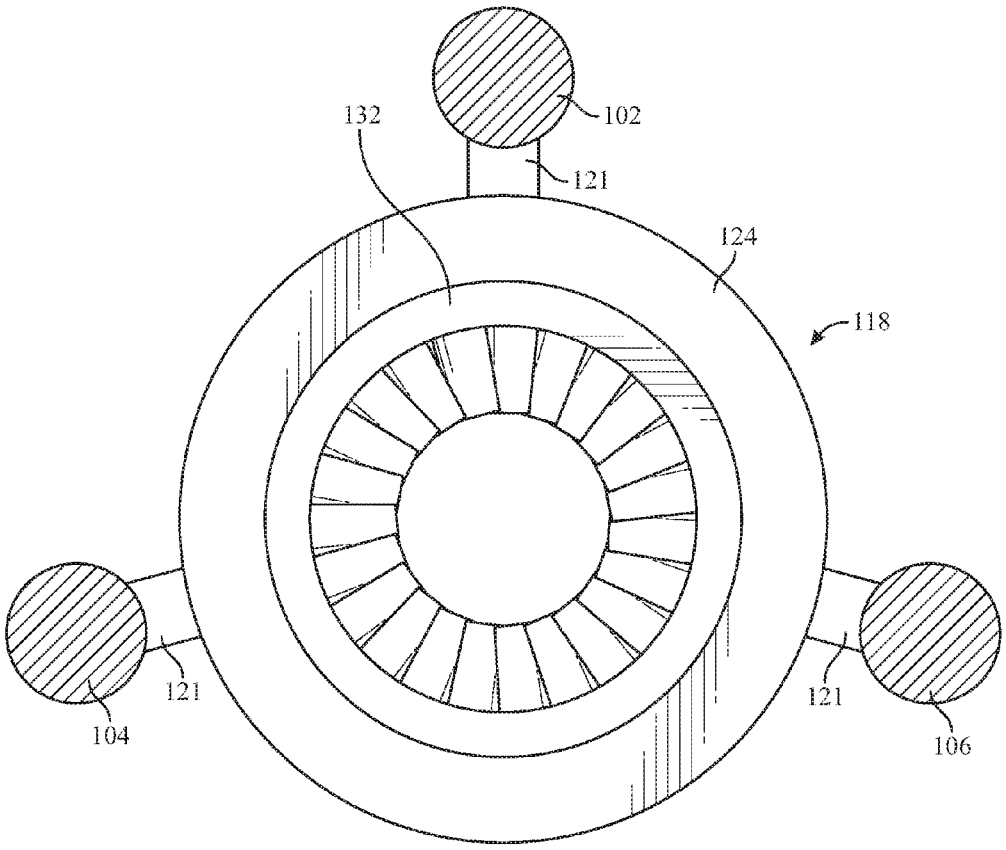
FIG. 2 is a cross-sectional view of an example recreational device illustrating a plurality of blades of a rotor assembly.

Referring now to FIG. 2, an example securement between the drum 124 and struts 102, 104, and 106 is illustrated. Again, this illustrates one of a possible plurality of drums of the rotor assemblies; for example, drum 124 of rotor assembly 118 is illustrated. A linkage, such as linkage 121, extends between each of struts 102, 104, and 106 and the drum 124.

FIG. 3 illustrates another example football 200 that comprises an outer covering or skin 202, rotor assemblies 206, 208, 210, 212, and 214 and a motor assembly 216. Additional or fewer rotor assemblies can be included. The skin 202 can comprise any suitable material used with recreational footballs or any other suitable material that would be known to one of ordinary skill the art. In one embodiment, the skin 202 comprises air intake apertures 211, 213, and 215. These air intake apertures 211, 213, and 215 provide a pathway for air to enter football 200. In another embodiment, the air intake apertures 211, 213, and 215 can extend around a circumference of the football 200. The air intake apertures can be disposed forward of their respective rotor assemblies. For example, air intake aperture 211 is located forward of rotor assembly 212, air intake aperture 213 is located forward of rotor assembly 206, and air intake aperture 215 is located forward of rotor assembly 214. These air intake apertures 211, 213, and 215 can comprise large openings in the skin 202, perforated sections in the skin 202, or other means for allowing air into the football 200. Additional or fewer air intake apertures can be utilized. In some embodiments, an air intake aperture is provided for each rotor assembly.

The skin 202 also comprises an air outlet opening 218 at a rear end of the football 200 that allows air to exit the football 200. That is, air that is received through the air intake apertures (for example, air intake apertures 211, 213, and/or 215), which is passed over the rotor assemblies (for example, rotor assembles 212, 206, and/or 214), exits through the air outlet opening 218.

Figure 4:
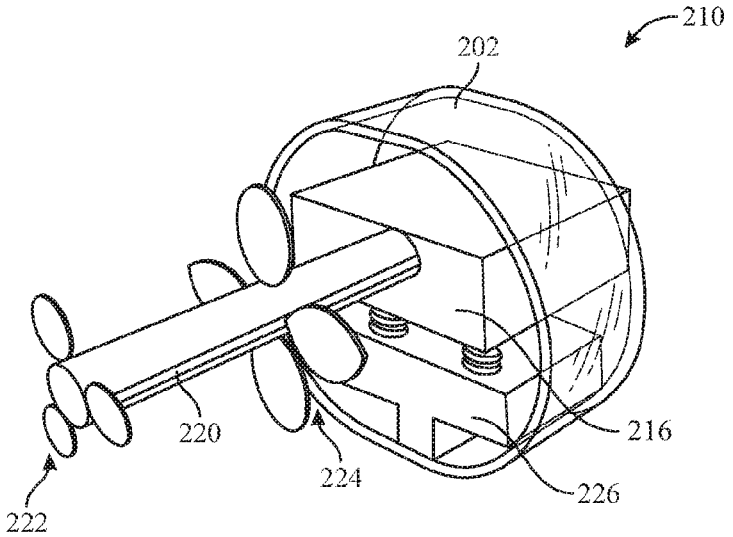
FIGS. 4 and 5 collectively illustrate an example motor assembly for use with embodiments of the present disclosure.
Figure 5:
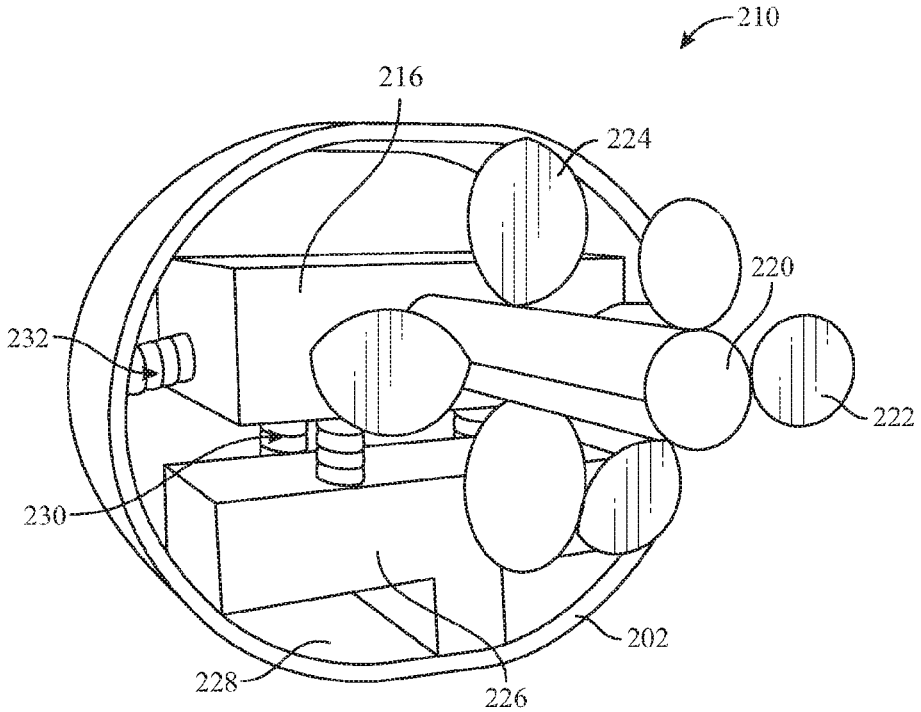

The motor (or rotor) assembly 210 is disposed rearwardly/downstream of the rotor assembly 208. In more detail, FIGS. 4 and 5 collectively illustrate the motor (assembly) 210. The motor assembly 210 comprises a motor 216 a shaft 220 rotatably coupled with the motor 216, and a plurality of propeller blades disposed on the shaft such as blade set 222 and blade set 224.

In one embodiment, the motor 216 is coupled with a t-shaped support 226. The support 226 is coupled to an inner sidewall 228 of the skin 202. A first set of vibrational dampers 230, such as springs, couples the motor 216 to the support 226, while a second set of vibrational dampers 232 extend between the motor 216 and the inner sidewall 228 of the skin 202.

When in flight, the motor 216 rotates the shaft 220 to spin the blade set 222 and the blade set 224, producing propulsion in the direction of travel of the football 200. Air propelled by the motor assembly 210, aided by the rotor assemblies 206 and 208, exits the air outlet opening 218 (see FIG. 3), propelling the football 200 forward. This configuration effectively reduces the throwing force required from a user.

Figure 6:
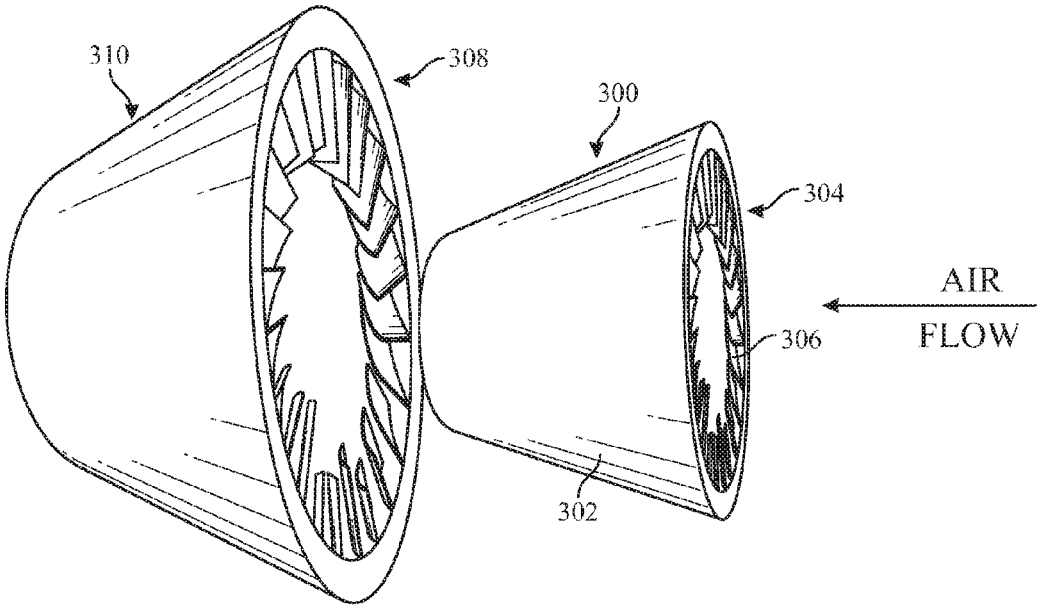
FIG. 6 is a perspective view of a pair of rotor assemblies having frusto-conical shapes.
Figure 7:
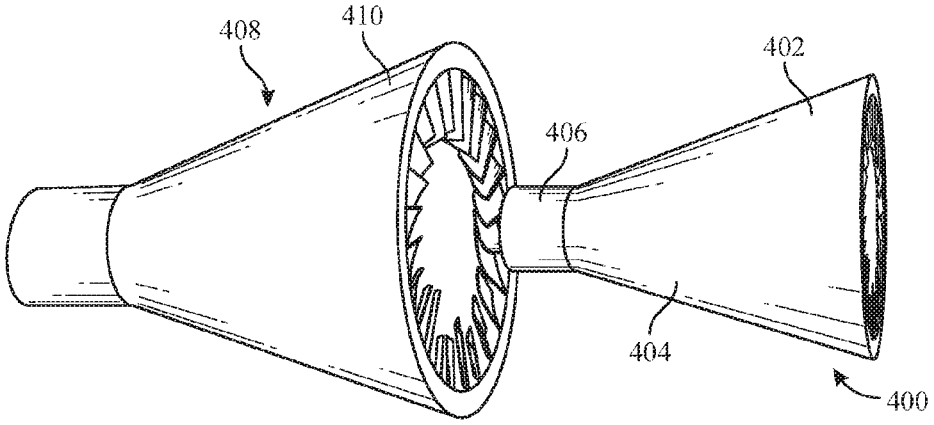
FIG. 7 is a perspective view of a pair of rotor assemblies having both a funnel and nozzle.
Figure 8:
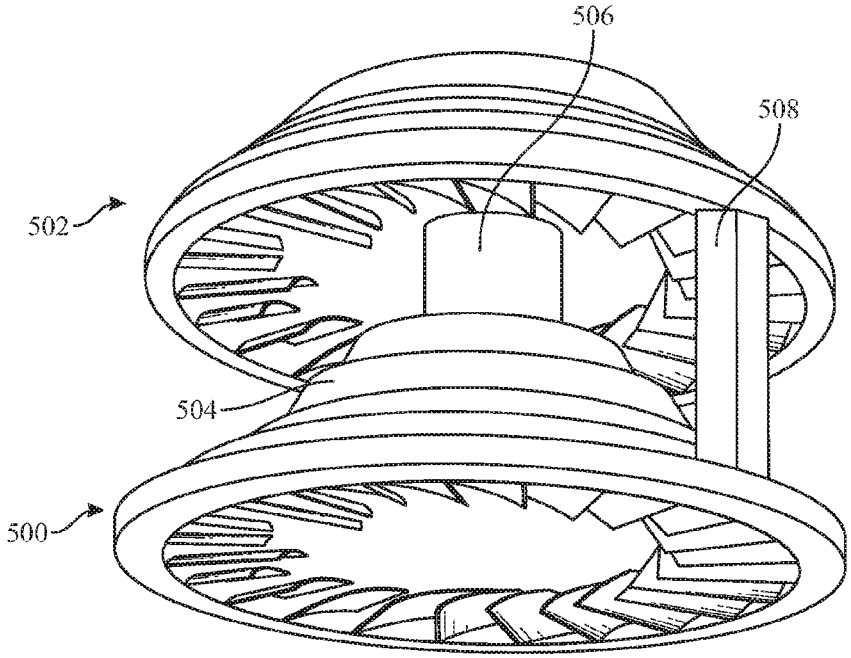
FIG. 8 is a perspective view of a pair of rotor assemblies having a funnel with a stair-stepped sidewall.

FIGS. 6-8 illustrate various embodiments of drums for use in the rotor assemblies of the recreational devices of the present disclosure. For example, FIG. 6 illustrates a recreational device that is identical to the recreational device of FIG. 3 with the exception that the rotor assemblies shown in FIG. 6, such as rotor assembly 300 comprise a drum 302 that is substantially frusto-conical (also referred to herein as frustoconical) in shape. When installed in a football of the present disclosure, a large open end 304 of the rotor assembly 300 functions as an inlet for receiving air. When air is passed through blades 306 of the rotor assembly 300, it exits a rear opening of the rotor assembly 300 and is directed into an inlet 308 of a downstream rotor assembly 310. Air also flows around an outer periphery of the rotor assembly 300 into the downstream rotor assembly 310 due to respective size differences. For example, the downstream rotor assembly 310 comprises a diameter that is greater than a diameter of the rotor assembly 300. This allows the rotor assembly 300 to fit proximate to a front of the football (again, the football has tapered ends because it is a prolate spheroid), while the downstream rotor assembly 310 is located closer to a middle of the football.

The use of frusto-conical shaped drums increases velocity of air passing through the rotor assemblies.

FIG. 7 illustrates a recreational device that is identical to the recreational device of FIG. 3 with the exception that the rotor assemblies shown in FIG. 7 include a rotor assembly 400 comprising a drum 402 having a funnel portion 404 and a nozzle portion 406. A second, downstream rotor assembly 408 receives air from the nozzle portion 406, as well as air flowing around an outer periphery of the funnel portion 404. The rotor assembly 400 and rotor assembly 408 are configured to be placed in series when disposed within a football. The wide open ends of the rotor assemblies 400 and 408 are inlets that receive airflow (note that air can enter the football and into the rotor assemblies 400 and 408 through air inlet apertures described above).

When installed in a football of the present disclosure, the funnel portion 404 of the rotor assembly 400 functions as an inlet for receiving air. When air is passed through blades of the rotor assembly 400, it exits the nozzle portion 406 of the rotor assembly 400 and is directed into the funnel portion 410 of a downstream rotor assembly 408. As illustrated, the downstream rotor assembly 408 comprises a diameter that is greater than a diameter of the rotor assembly 400. This allows the rotor assembly 400 to fit proximate to a front of the football (again, the football has tapered ends because it is a prolate spheroid), while the downstream rotor assembly 408 is located closer to a middle of the football.

FIG. 8 illustrates a recreational device that is identical to the recreational device of FIG. 3 with the exception that the rotor assemblies shown in FIG. 8 include another example pair of rotor assemblies 500 and 502. The rotor assembly 500 comprises a sidewall 504 that is stairstepped. Rotor assembly 500 terminates with a nozzle 506. The rotor assembly 502 is located downstream of the rotor assembly 500 and receives air from the nozzle 506.

In some embodiments, the rotor assemblies 500 and 502 are coupled together with a support strut 508. In other embodiments, the rotor assemblies 500 and 502 are coupled together with more than one support strut 508. The support strut 508 can provide more structural support and stability (for example, by minimizing oscillation) within the recreational device, according to various embodiments.

Figure 9:
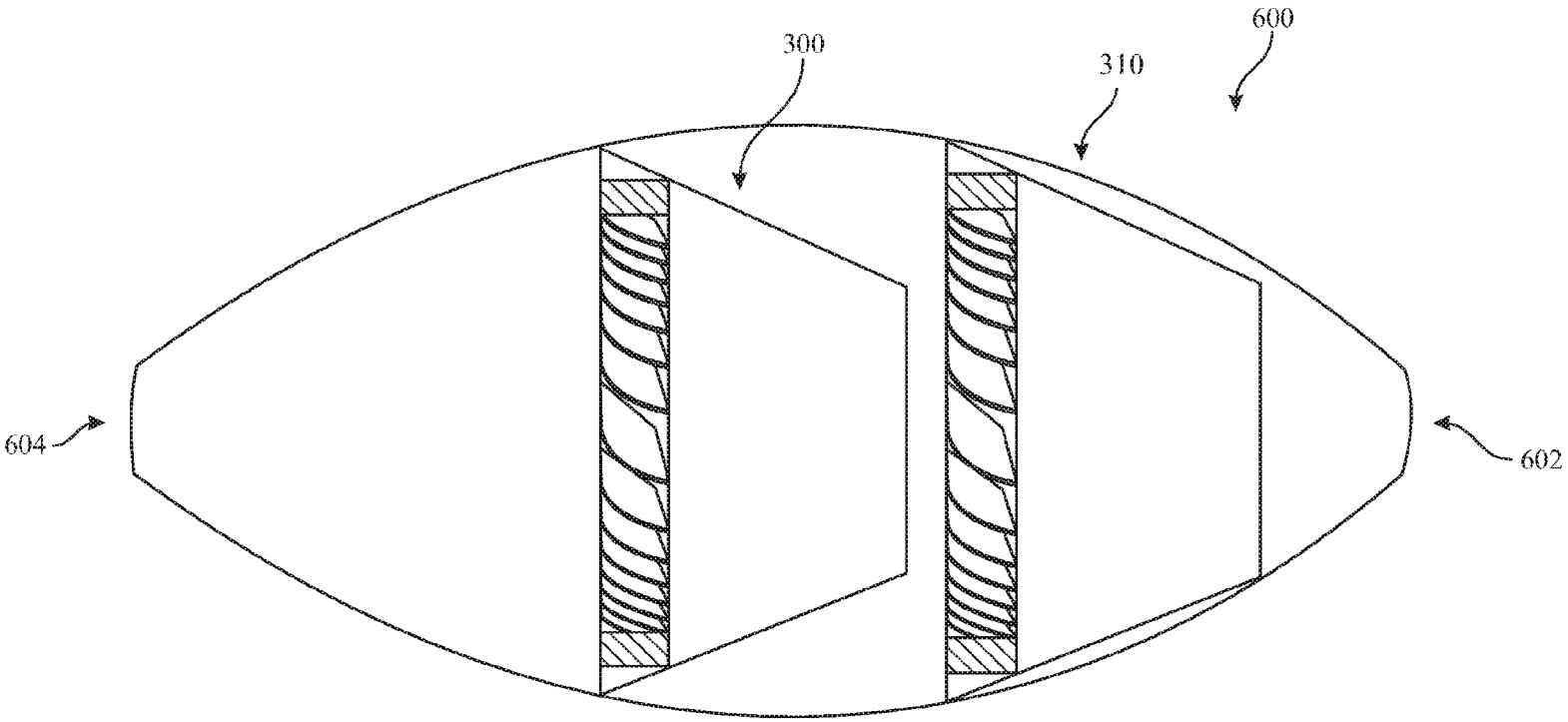
FIG. 9 is a cross-section of an exemplary football comprising the rotor assemblies of FIG. 6.

FIG. 9 is a cross-section of another example football 600 that comprises the rotor assemblies 300 and 310 of FIG. 6. Additionally, the football 600 comprises a skin that includes a first opening 604 and a second opening 602. When the football 600 is thrown, air enters the first opening 604 causing the rotor assembly 300 to spin. Due to the shape (e.g., conical shape) of the rotor assembly 300, higher velocity air is injected into the rotor assembly 310. The combined rotation of the rotor assemblies 300 and 310 changes the flight behavior of the football 600 compared to similar devices with no rotors.

Figure 10:
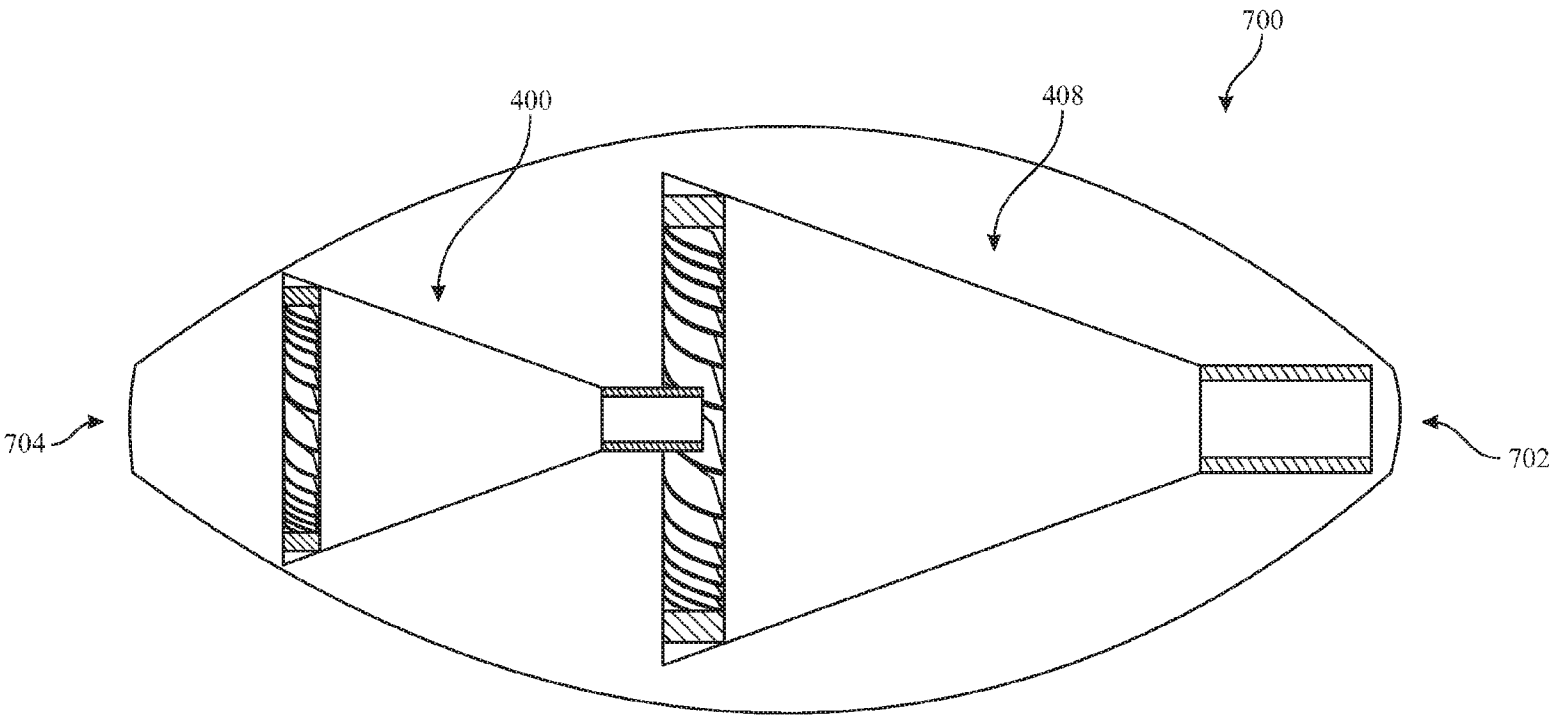
FIG. 10 is a cross-section of an exemplary football comprising the rotor assemblies of FIG. 7.

FIG. 10 is a cross-section of another example football 700 that comprises the rotor assemblies 400 and 408 of FIG. 7. Additionally, the football 700 comprises a skin that includes a first opening 704 and a second opening 702. When the football 700 is thrown, air enters the first opening 704 causing the rotor assembly 400 to spin. Due to the shape (e.g., funnel shape) of the rotor assembly 400, higher velocity air is injected into the rotor assembly 408. The combined rotation of the rotor assemblies 400 and 408 changes the flight behavior of the football 700 compared to similar devices with no rotors. In some embodiments, a nozzle of the rotor assembly 400 can nest inside the rotor assembly 408. In other embodiments, the rotor assemblies 400 and 408 can be spaced apart from one another (e.g., not nested).

Figure 11:
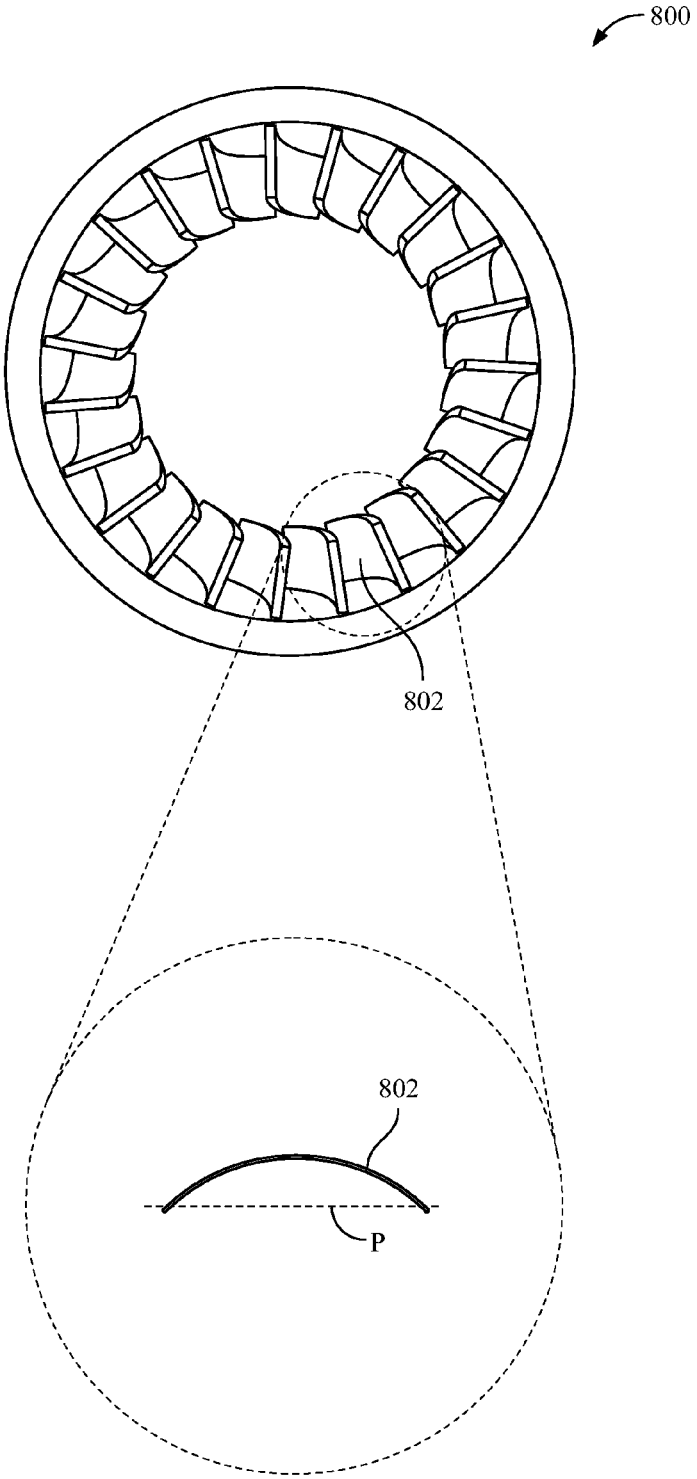
FIG. 11 is a perspective view of a rotor assembly comprising blades with a curved profile.

FIG. 11 is a perspective view of an example rotor assembly 800 that comprises a plurality of blades, such as blade 802. In some embodiments, the blade 802 comprises a curved profile as illustrated in the close-up view of blade 802. The blade 802 is curved relative to a reference plane P. In accordance with other embodiments, the blades can be any of cambered, twisted, and/or curved, or any combinations thereof.

Figure 12:
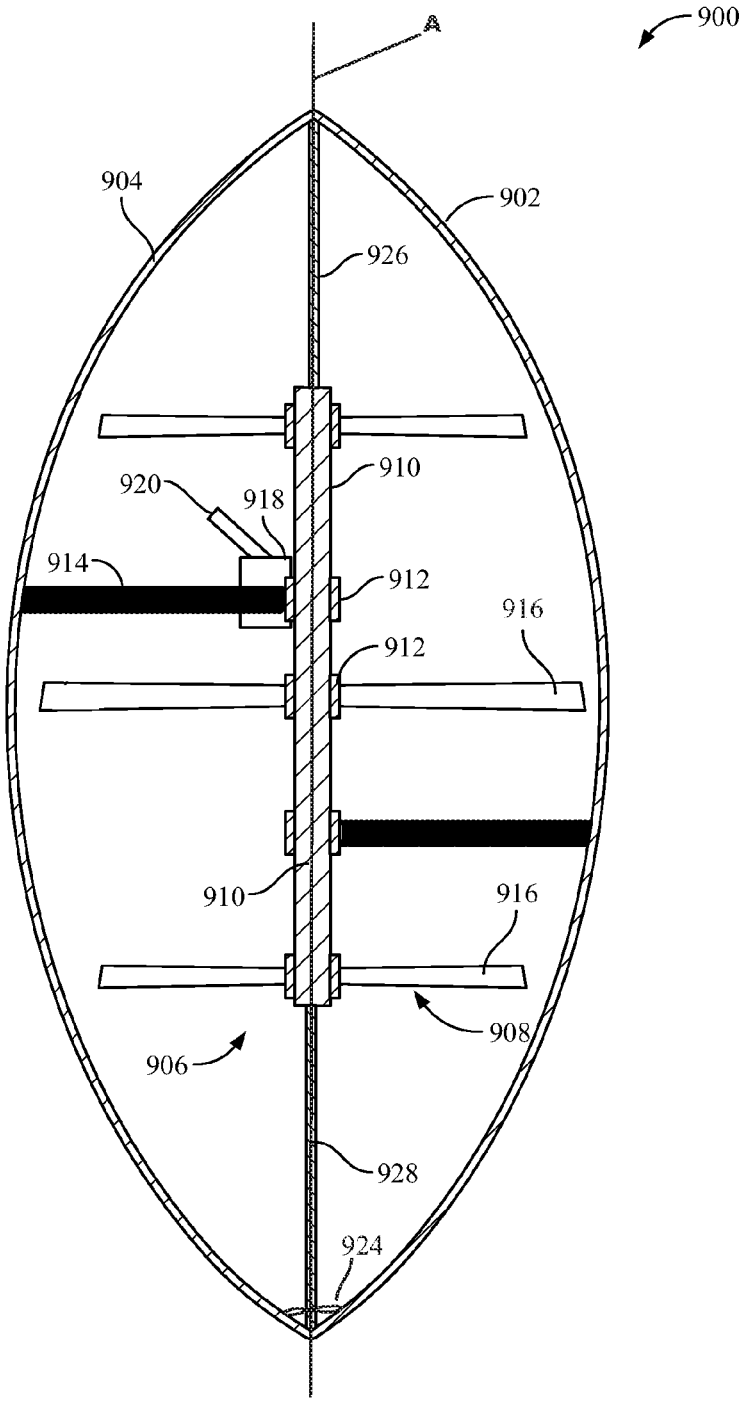
FIG. 12 is a cross-sectional view of an example football comprising a plurality of sets of fan blades and vibrational dampers.

FIG. 12 illustrates another example football 900. The football 900 generally comprises a shell 902 forming a prolate spheroid frame 904. In some embodiments, the prolate spheroid frame 904 can be a continuous member that forms the outer surface of the football 900. In other embodiments, the prolate spheroid frame 904 can be created from a plurality of interconnected frame members, as illustrated in the embodiments above. That is, the interconnected frame members can include elongated members that provide structural support and form the basic prolate spheroid shape of the football 900.

In some embodiments, the football 900 comprises a drive assembly 906 that includes a plurality of fan sub-assemblies, such as fan sub-assembly 908. The drive assembly 906 can also comprise a shaft 910 that can freely rotate within the football 900, and specifically, within a space created by the prolate spheroid frame 904.

In various embodiments, the shaft 910 is located in alignment with a central axis A defined by the prolate spheroid frame 904.

In some embodiments, the shaft 910 is held in position within the prolate spheroid frame 904 by use of clamps, such as clamp 912. The clamp 912 is secured around the shaft 910 in such a way that the shaft 910 can freely rotate. Each clamp 912 is coupled with the prolate spheroid frame 904 via a spring or other vibration damping member, such as spring 914. A plurality of clamp and spring pairs can be coupled at various points along the shaft 910. The springs can help to damp impact forces when the football 900 is in use, for example, when the football 900 is caught or when it impacts a surface.

With respect to the fan sub-assembly 908, each of the fan assemblies comprises a plurality of blades. In some embodiments the fan assemblies rotate around or in conjunction with the shaft 910. For example, fan sub-assembly 908 can include blades 916 that extend directly from the shaft 910. As with other embodiments, the blades can be any of cambered, twisted, curved, or combinations thereof.

The drive assembly 906 can comprise any number of fan sub-assemblies as desired.

To be sure, the one or more fan sub-assemblies can change at least one aerodynamic aspect of flight of the recreational device when air passes through the prolate spheroid frame 904 and across the plurality of blades of the one or more fan sub-assemblies as the recreational device spirals during flight. For example, the fan sub-assemblies produce added lift of the football 900.

In some embodiments, the drive assembly 906 can comprise a motor 918 that is rotatably coupled to the shaft, for example, through a drive belt or gearing. The motor 918 can be supported using springs or struts, such as support member 920. The support member 920 couples to the prolate spheroid frame 904. The motor 918 can be controlled to turn on and off through any of a mechanical switch, an acceleration sensor (in which the motor 918 turns on when acceleration of the football 900 is sensed), through remote operation, and the like. For example, the motor 918 can include a wireless communication module that allows for short range wireless control of the motor 918 through Bluetooth or other similar protocol communication. An application installed on a mobile device can be used to control operation of the motor 918 remotely.

In various embodiments, an optional addition can include a propeller 924 that is coupled to a terminal end of the shaft 910. The propeller 924 can also freely rotate relative to the shaft 910. In some embodiments, the motor 918 can be coupled with the propeller 924 rather than the shaft 910 such that the motor 918 can power the propeller 924.

In some embodiments, vibrational dampers 926 and 928 can be incorporated that extend from the shaft 910 to dampingly couple the shaft 910 with the prolate spheroid frame 904.

A shell 902 is optional, in some embodiments, allowing the prolate spheroid frame 904 to form the outer portion of the football 900. In some instances, the shell 902 can comprise a skin or wrapping that covers the prolate spheroid frame 904, such as a typical football material. As with embodiments described infra, the shell 902 can comprise apertures, air vents, or other openings that allow air to enter the football 900 when the football 900 is thrown.

In some embodiments, the shell 902 is open on either the first and/or second ends of the football 900 to promote additional airflow through the football 900 and over the fan sub-assemblies.

Figure 13:
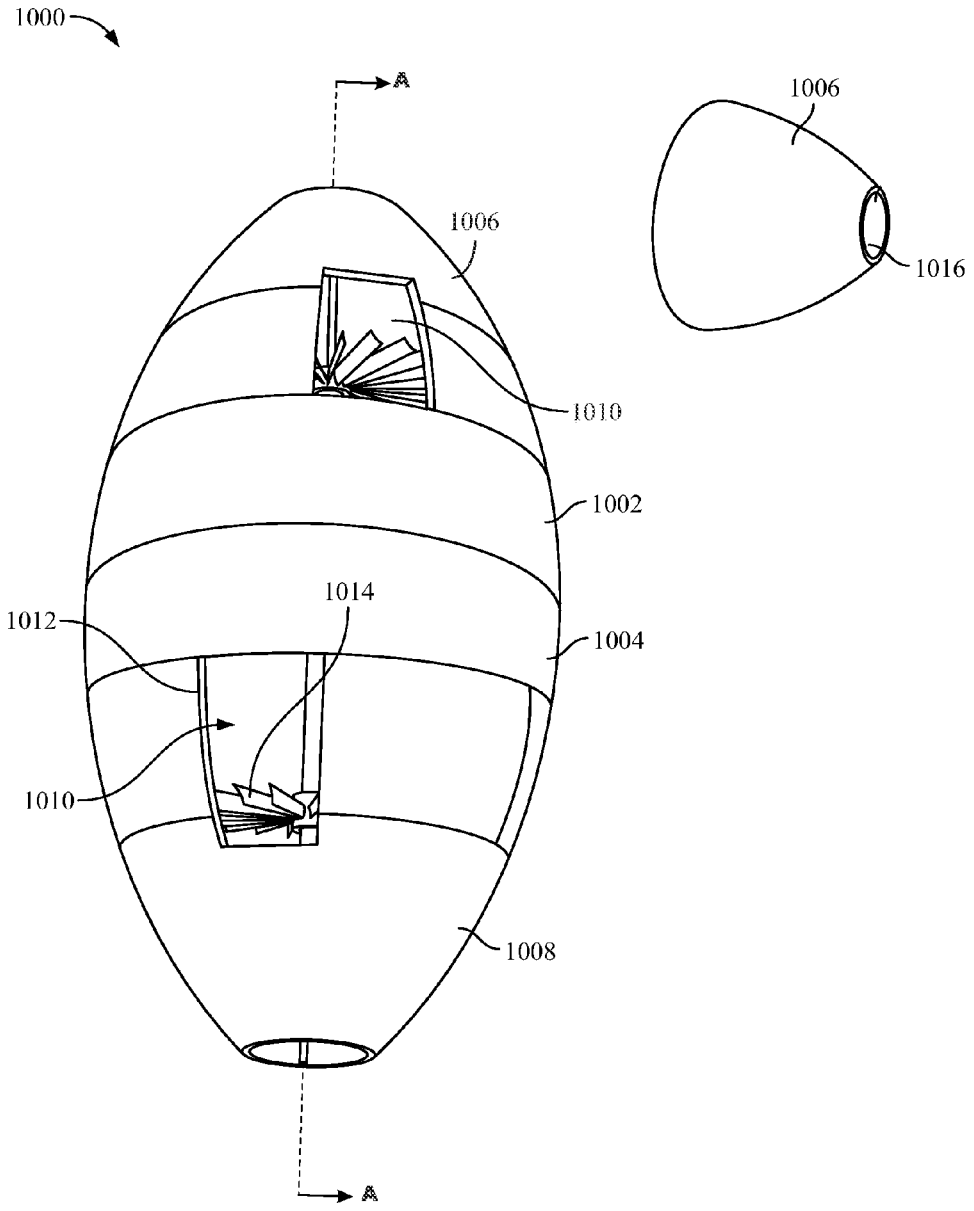
FIG. 13 is a perspective view of another example football comprising mid-sections and end caps, where the end caps have open ends.
Figure 14:
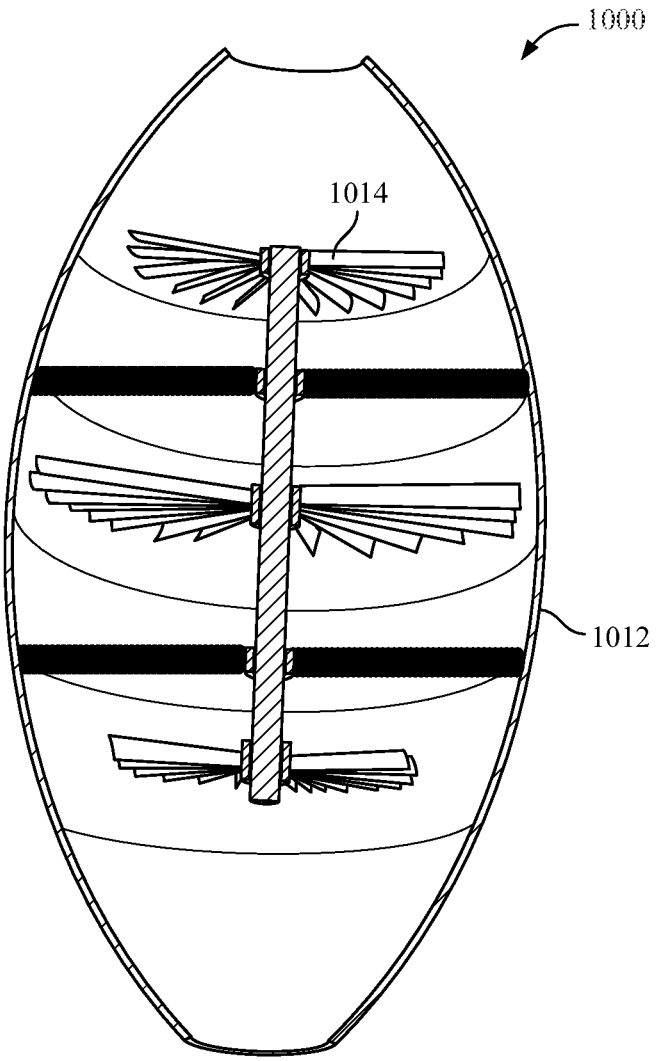
FIG. 14 is a cross-sectional view of the example football of FIG. 13.

FIGS. 13 and 14 collectively illustrate another example football 1000 comprising mid-sections 1002 and 1004 and end caps 1006 and 1008, where the end caps have open ends. Each of the mid-sections, such as mid-section 1002, comprises a rotor assembly 1010. In some embodiments, the rotor assembly 1010 comprises a frame section 1012 that forms a part of an outer surface of the football 1000. The rotor assembly 1010 comprises a plurality of blades 1014 that are rotatably supported within the frame section 1012. As with other embodiments, the plurality of blades 1014 rotating to create a lift force when the football is thrown through the air. The plurality of blades 1014 are rotatably supported within the frame section 1012 to allow each of the plurality of blades 1014 to spin when air is passed over the blades 1014. As with other embodiments described infra, the frame section 1012 can function as, or include, a race bearing or other rotatable bearing configuration that allows each of the plurality of blades 1014 to be held in rotating support, coupled to the frame section 1012.

In some embodiments, the second mid-section 1004 also comprises a frame section and plurality of blades. The football 1000 can comprise any number of mid-sections as desired. The mid-sections 1002 and 1004 can be coupled together, such as through threading of the edge of the frame sections, allowing the football 1000 to be modular so that the user can insert additional mid-sections or remove mid-sections as desired.

According to some embodiments, the end caps, such as end cap 1006 have an open terminal end 1016 that can allow air to enter the football 1000 when the football 1000 is thrown. End cap 1008 is also provided with a similar opening that can allow air to exit the football 1000. As with the embodiment of FIG. 15, the end caps can also comprise air vents that increase the airflow through the football 1000. The end caps can be removed and replaced as desired.

Figure 15:
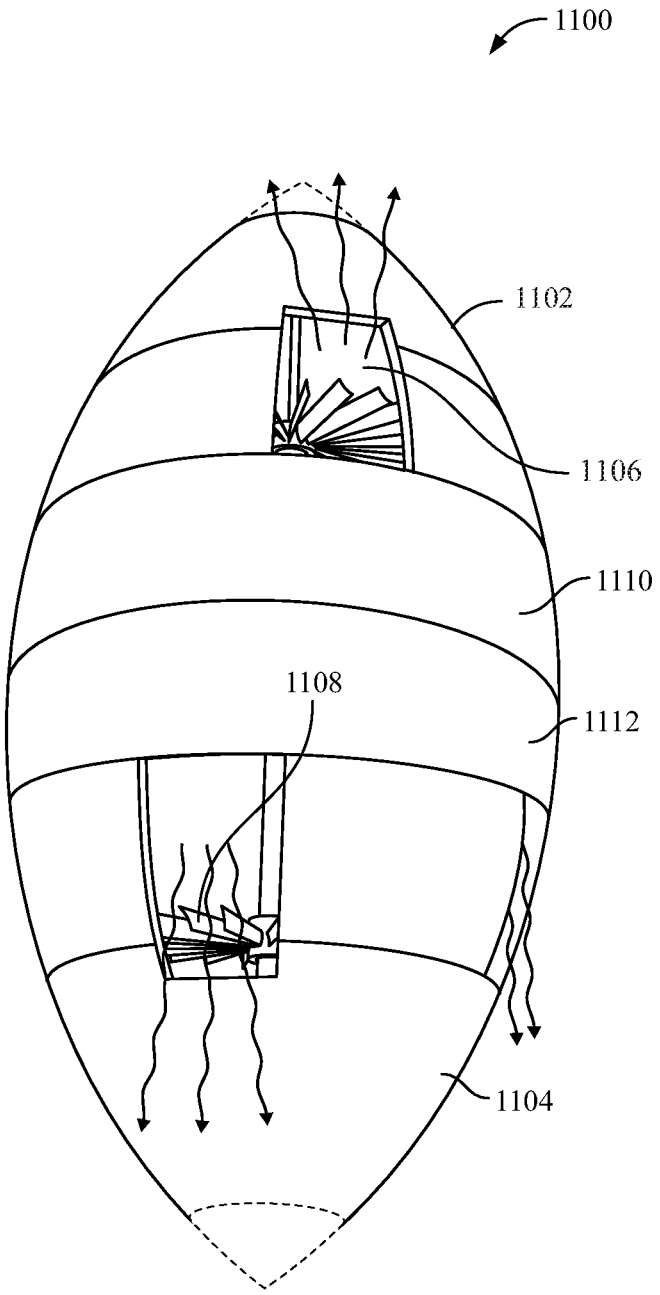
FIG. 15 is a perspective view of another example football comprising mid-sections and end caps, where the end caps have closed ends and air vents.

FIG. 15 illustrates another example football 1100 that is constructed similarly to the embodiment of FIGS. 13 and 14 with the exception that the end caps 1102 and 1104 have closed ends. Rather than using open ends, the end caps 1102 and 1104 have air vents, apertures, or other similar openings, such as openings 1106 and 1108 that allow for air to enter into the football 1100. In some embodiments, opening 1106 is disposed forwardly of mid-section 1110 and opening 1108 is disposed rearwardly of mid-section 1112. Again, in other embodiments, the end caps can also comprise open ends, if desired.

While this technology is susceptible of embodiment in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A recreational device, comprising:

a shell forming a prolate spheroid frame;

a shaft disposed within the prolate spheroid frame and located along a central axis defined by the prolate spheroid frame;

vibrational dampers extending from the shaft so as to dampingly couple the shaft with the prolate spheroid frame; and one or more fan assemblies each having a plurality of blades, the one or more fan assemblies rotating around or in conjunction with the shaft, the one or more fan assemblies changing at least one aerodynamic aspect of flight of the recreational device when air passes through the prolate spheroid frame and across the plurality of blades of the one or more fan assemblies as the recreational device spirals during flight.

2. The recreational device according to claim 1, wherein a portion of the vibrational dampers extend from terminal ends of the shaft.

3. The recreational device according to claim 1, wherein a portion of the vibrational dampers extend between the prolate spheroid frame and clamps that couple with the shaft.

4. The recreational device according to claim 1, further comprising a propeller disposed on a terminal end of the shaft.

5. The recreational device according to claim 1, wherein a first of the one or more fan assemblies is disposed at an open inlet end of the prolate spheroid frame.

6. The recreational device according to claim 5, wherein at least one of the one or more fan assemblies is disposed at an open outlet end of the prolate spheroid frame.

7. The recreational device according to claim 1, wherein the shell is a skin.

8. The recreational device according to claim 1, further comprising a motor assembly that comprises a motor, the motor rotating the shaft or a plurality of propeller blades disposed on the shaft.

* * * * *